US008871326B2

(12) United States Patent
Flennert

(10) Patent No.: US 8,871,326 B2
(45) Date of Patent: Oct. 28, 2014

(54) FIRE PROTECTION ELEMENT

(75) Inventor: Bruno Flennert, Willanzheim (DE)

(73) Assignee: Knauf Gips KG, Iphofen (DE)

( * ) Notice: Subject to any disclaimer, the term of this patent is extended or adjusted under 35 U.S.C. 154(b) by 457 days.

(21) Appl. No.: 13/099,802

(22) Filed: May 3, 2011

(65) Prior Publication Data

US 2011/0274886 A1 Nov. 10, 2011

(30) Foreign Application Priority Data

May 7, 2010 (DE) ..... 20 2010 005 397 U

(51) Int. Cl.

| | |
|---|---|
| ***B32B 13/14*** | (2006.01) |
| ***B32B 3/26*** | (2006.01) |
| ***E04B 1/94*** | (2006.01) |
| ***E04C 2/04*** | (2006.01) |
| ***F24F 13/02*** | (2006.01) |
| *F24F 11/00* | (2006.01) |

(52) U.S. Cl.

CPC ..... *E04C 2/043* (2013.01); *F24F 2011/0095* (2013.01); *E04B 1/944* (2013.01); *F24F 13/0263* (2013.01)

USPC ..... 428/122; 428/294.7; 428/312.4; 442/374; 442/375; 442/381; 442/398

(58) Field of Classification Search

USPC ..... 428/122, 294.7, 312.4; 442/374, 375, 442/381, 398

See application file for complete search history.

(56) References Cited

U.S. PATENT DOCUMENTS

2002/0151240 A1* 10/2002 Smith et al. ..... 442/327
2003/0021957 A1* 1/2003 Born ..... 428/167

* cited by examiner

*Primary Examiner* — Brent O'Hern

(74) *Attorney, Agent, or Firm* — Panitch Schwarze Belisario & Nadel LLP

(57) ABSTRACT

A fire protection element, in particular for cladding steel supports, ventilation or cable ducts, is provided with at least one plate formed as a corner member. The plate(s) has/have a gypsum core at least partly sheathed with a nonwoven glass fabric.

18 Claims, 2 Drawing Sheets

FIRE PROTECTION ELEMENT

BACKGROUND OF THE INVENTION

The invention relates to a fire protection element, in particular for cladding steel supports or as a structural component of ventilation or cable ducts, and further relates to a fire protection half-shell element.

Fire protection claddings of the herein mentioned kind are known. They serve as a cladding for steel or wooden supports, as well as structural components for constructing ventilation or cable ducts to prevent fire from spreading. They usually have a gypsum core, which is at least in part provided with a surface coating, in particular made of gypsum plasterboard. The good protective action of gypsum building materials against fire is generally known, so that a more detailed explanation thereof will be omitted here. Conventional fire protection claddings are made of gypsum plates sheathed by gypsum plasterboard, which are configured as a corner member or composed of a plurality of plates arranged essentially perpendicular to each other. Claddings realized as corner members are in this case preferably used, since they do not exhibit externally-accessible joints and to this extent are considerably more fire-resistant in their fire protection properties, especially in the case of fire impacting from outside. A disadvantage of the conventional fire protection cladding elements, formed of gypsum plasterboard-sheathed corner members of the known kind is that they cannot claim the highest fire protection class because of their outer or inner gypsum plasterboard layers.

BRIEF SUMMARY OF THE INVENTION

It is therefore an object of the present invention to provide a fire protection cladding element of further improved fire protection technology.

According to the invention, the fire protection element is used in particular for cladding steel supports or as a component for constructing ventilation or cable ducts and is characterized in that it comprises at least one plate configured as a corner member having a gypsum core at least partly sheathed by a nonwoven glass fabric.

A basic idea of the present invention is hence to substantially increase the fire resistance of a bent or folded fire protection element, which in particular serves to clad steel supports or the like or as a structural component for constructing ventilation or cable ducts, by using a nonwoven glass fabric coating or nonwoven glass fabric sheathing.

A fire protection element having a U-shaped configuration is particularly preferred. The nonwoven glass fabric may furthermore be gypsum-coated. Mainly in the bend areas, the outer surface of the bent or folded plate is provided with an intact nonwoven glass fabric layer. This aspect is essential since a nonwoven glass fabric easily tears or breaks, particularly in the bending areas, but on the other hand an intact and continuous nonwoven glass fabric layer needs to be ensured, especially in the bending area, so as not to affect the fire resistance. The surfaces and/or longitudinal sides of the gypsum core are in particular sheathed with a nonwoven glass fabric. Moreover, the gypsum core can be fiber-reinforced.

The fire protection element preferably comprises two plates formed as a corner member and nested within each other, wherein at least the outer plate, which is configured as a corner member, has a gypsum core at least partly sheathed with a nonwoven glass fabric. The two plates are preferably formed as a corner member having an U-shaped cross-section.

For further achieving the above-mentioned object, a fire protection element of the above type is proposed, having at least one plate configured as a corner member, the inner surface of the plate, at least in the folding areas, being provided with a metal coating acting as a film hinge.

According to an embodiment of the invention, the fire protection element serves in particular to clad steel supports or as a structural component for constructing ventilation or cable ducts and is characterized in that it comprises at least one plate formed as a corner member, the inner surface of the plate being provided with a metal coating acting as a hinge film at least in the bending areas or folding areas.

Another basic idea of the present invention is hence to prevent the plate from breaking in the bending areas by providing a metal coating at least in the bending areas, which imparts stability to the bending area but also fundamentally improves the fire prevention properties at the same time.

The metal coating preferably comprises aluminum. Furthermore, the metal coating can be applied completely over the entire inner surface. Especially in the case of a fire impacting from outside, this can contribute to inhibiting or preventing crystal water from evaporating and, as a consequence, the gypsum core or cores being able to resist the impact of the fire for a longer time.

A fire protection half-shell element having two partial elements nested within each other and having an essentially U-shaped cross-section, wherein the two partial elements are respectively connected to each other at their corner areas by a connecting element, is proposed to achieve the above-cited object.

The fire protection shell element in particular serves to clad steel supports or as a structural component for constructing ventilation or cable ducts and has two partial elements nested within each other which each have an essentially U-shaped cross-section. Each partial element preferably has a short U-leg and a long U-leg as viewed in cross-section. The two partial elements are arranged relative to each other, such that the short U-leg of one partial element rests against the long U-leg of the other partial element. The outer surface of an inner partial element hence virtually rests against the inner surface of an outer partial element. This creates a circumferential stepped profile, so that a completely closed fire protection cladding can be created by joining one fire protection half-shell element to another fire protection half-shell element. An embodiment of the invention further provides for the two partial elements to be respectively connected to each other at their corner areas by a connecting element which preferably has a trapezoidal base as viewed in cross-section.

The fire protection half-shell element according to this embodiment of the invention creates a particularly safe cladding or casing of steel supports and also wooden supports as well as structural components for constructing ventilation or cable ducts or the like. The simple joining of two fire protection half-shell elements of preferably identical configuration allows for completely cladding a steel beam or a steel support, or constructing a ventilation or cable duct, in a simple manner. The connecting elements in the corner areas between the partial elements make the fire protection half-shell element according to this embodiment of the invention particularly stable. Moreover, the two partial elements can thereby be manufactured, in particular folded or bent, so that they do not fit into each other in an interlocking manner but can only be interconnected by the trapezoidal connecting element. This allows each partial element to be manufactured in the simplest way. In sum, the fire protection half-shell element can be produced in a cost-efficient and simple manner right within the factory and allows for rapid and uncomplicated assembly. Furthermore, the fire protection half-shell element is formed to be particularly stable.

Preferably, the inner surface of the inner partial element is provided with a metal coating, in particular an aluminum coating. Due to the aluminum coating on the inner surface of the inner element, this can be produced in one piece, since the aluminum coating virtually serves as a film hinge along the fold lines, as will be described below in more detail. Moreover, the aluminum coating prevents nonwoven glass fabric, which is usually provided on the gypsum core forming the partial elements as a coating, from entering into a ventilation duct, if this is delimited by a fire protection half-shell element of the type mentioned here. Finally, the metal or aluminum coating can prevent crystal water from evaporating in the case of fire impacting from outside, and instead can inhibit or prevent water or expelled vapor from exiting in the case of fire impacting from outside, so that fire resistance as a whole is increased.

As noted above, the two partial elements each preferably have a gypsum core, with the gypsum core of at least one partial element being provided with a surface coating of a nonwoven glass fabric, at least in some areas. The gypsum cores are moreover preferably fiber-reinforced so as to fulfill the highest of fire conditions. Incidentally, the two partial elements can be arranged staggered relative one another in a longitudinal direction of the fire protection half-shell element. Hereby, a stepped profile is in turn formed, which ensures a safe overlapping connection of a plurality of fire protection half-shell elements in a longitudinal direction.

Moreover, in particular the inner partial element may be provided to be shorter than the outer partial element as viewed in a longitudinal direction. In this embodiment as well, a stepped profile is formed, at least on a front-side area of the fire protection half-shell element.

Preferably, the length of the connecting element is provided to correspond to the length of the outer partial element. The stability of the fire protection half-shell element can thus be further increased.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
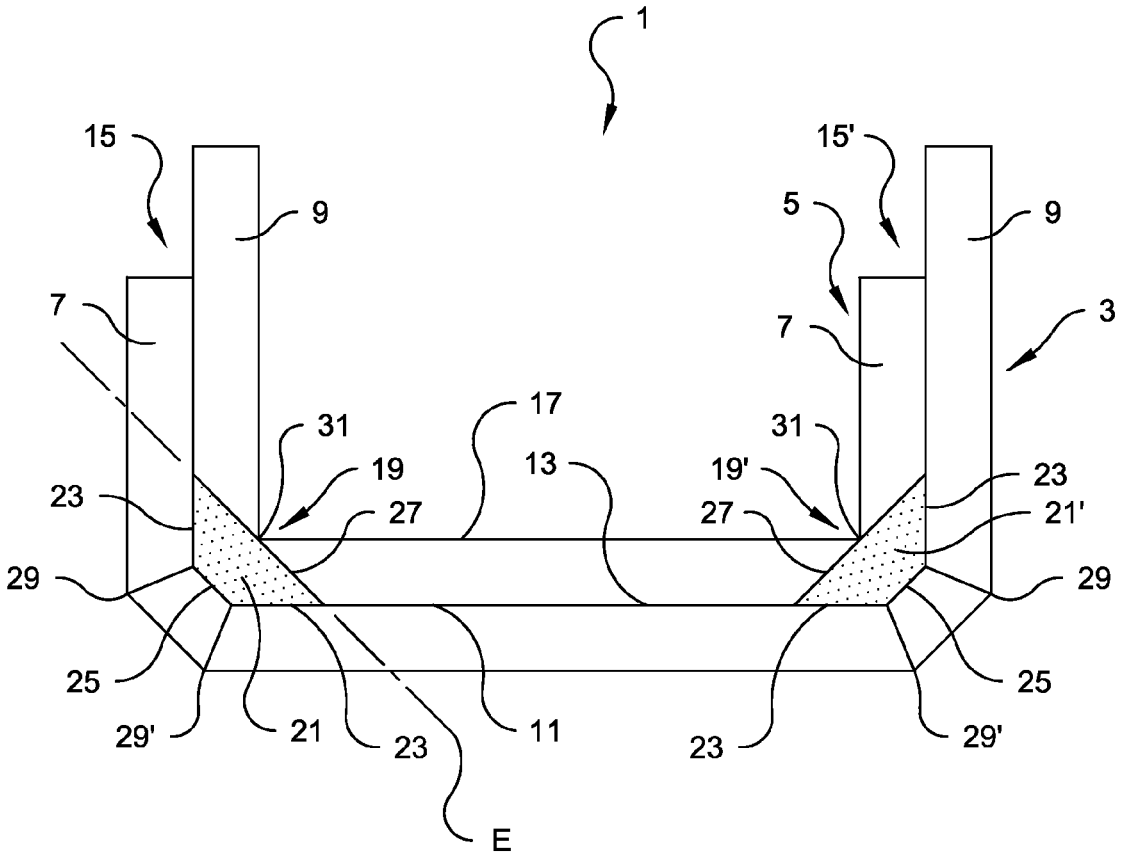
FIG. 1 is a schematic sectional representation of a fire protection half-shell element according to an embodiment of the invention.

FIG. 1 shows a schematic representation of a cross-section through a fire protection element and in particular a fire protection half-shell element 1 according to an embodiment of the invention. The fire protection half-shell element 1 comprises a first outer partial element 3 and a second inner partial element 5, each having an essentially U-shaped cross-section and being arranged nested within each other, as will be described below in more detail.

The first partial element 3 is formed by an outer plate formed as a corner member, whereas the second partial element 5 is formed by an inner folded plate formed as a corner member.

The two partial elements 3 and 5 each have a short U-leg 7 and a long U-leg 9. The two partial elements 3 and 5 are arranged to be nested within each other so that in each case the short U-leg 7 of one partial element rests against the long U-leg 9 of the other partial element. FIG. 1 clearly shows that the short U-leg 7 of the outer partial element 3 rests against the long U-leg 9 of the inner partial element 5 and the short U-leg 7 of the inner partial element 5 rests against the long U-leg 9 of the outer partial element 3.

Furthermore, the outer bottom surface 11 of the inner partial element 5 rests against the inner bottom surface 13 of the outer partial element 3. It is understood that the fire protection half-shell element 1 has a length which extends in the longitudinal direction, respectively perpendicular to the image plane in FIG. 1. The two partial elements 3 and 5 need not be of equal length in the longitudinal direction. Rather the inner partial element 5 may be provided to be shorter than the outer partial element 3 so that a stepped profile is formed between the outer partial element 3 and the inner partial element 5 in the longitudinal direction. However, the partial elements 3 and 5 can preferably also be of equal length but joined to each other to be longitudinally displaced by a measure x, so that the fire protection half-shell elements each form a stepped profile at both ends. In this manner, a plurality of fire protection half-shell elements 1 can be connected to each other to be overlapping in the longitudinal direction. Thus, a connection of a plurality of fire protection half-shell elements 1 is particularly safe.

FIG. 1 makes clear that the first outer partial element 3 and the second inner partial element 5, due to the arrangement shown there of the short and long U-legs 7 and 9, likewise form stepped profiles 15 and 15', which extend perpendicular to the image plane. For manufacturing a fire protection full-shell element, two preferably identical fire protection half-shell elements 1 can simply be joined in such an overlapping manner that a stepped profile 15' interacts with a stepped profile 15. In this manner, the two outer partial elements 3 of two fire protection half-shell elements form a closed duct, just as the then-joined inner partial elements 5 which enclose a steel support or the like.

It is understood that the short legs 7 of the two partial elements 3 and 5 are preferably of equal length. The same applies to the legs 9 of the partial elements 3 and 5. Only then is it guaranteed that two ducts nested within each other, closed in the circumferential direction and arranged to be coaxial to each other, are created upon joining two identical fire protection half-shell elements.

The inner surface 17 of the inner bent plate or of the inner partial element 5, is provided with a metal coating, in particular an aluminum coating, at least in some areas. The metal coating forms a film hinge in the fold areas; i.e. the inner corners of the plate bent in a U-shape. Preferably, the coating extends over the entire inner surface of the inner partial element 5. In this manner, the plate is prevented from breaking due to the nonwoven glass fabric coating during the bending process and also thereafter on the one hand and, on the other hand, nonwoven glass fabric is prevented from escaping into a ventilation duct provided the fire protection half-shell element is intended for such a ventilation duct.

The inner partial element 5 can be interconnected with the outer partial element 3 in a suitable manner, in particular by mutual adhesion.

The dimensions of the fire protection half-shell element 1 can be adapted according to the respective purpose of application. Of course, the dimensions of the inner partial element 5 and the outer partial element 3 need to be adapted to each other, such that the inner partial element 5 can be fit into the outer partial element 3 so as to be at least partly interlocking.

FIG. 1 further makes clear that there is no direct connection between the two partial elements in the corner areas 19, 19' of the partial elements 3 and 5, but that they are rather connected to each other by connecting elements 21, 21'.

The connecting elements are three-dimensional bodies which extend along the longitudinal direction of the fire protection half-shell element 1, i.e. perpendicular to the image plane, and have a trapezoidal cross-section. The connecting elements preferably also have a gypsum core sheathed by a nonwoven glass fabric. As viewed in cross-section, the connecting elements 21, 21' each have two legs 23, a short bottom side 25 and a long bottom side 27. The legs 23 and bottom side 25 of the connecting elements 21, 21' rest against the inner surface of the outer partial element 3, and their long bottom side 27 rests against the outer surface of the inner partial element 5.

For reasons of stability, the connecting elements 21 and 21' are preferably formed to be exactly as long as the outer partial element 3. Basically, however, it is also conceivable to only adapt the connecting elements to the length of the inner partial element 5.

At an end of each leg 7 and 9, the outer partial element 3 in each case comprises two folding or bending areas, in particular bending edges 29 and 29'. The outer partial element 3 formed in one piece is bent along the bending edges which extend in a longitudinal direction, as will be explained below in more detail with reference to FIGS. 2 and 3.

For this purpose, the outer partial element 3 is provided with V-shaped grooves which can no longer be recognized in FIG. 1 due to the U-shaped bent state of the outer partial element 3.

At each end of the legs 7 and 9, the inner partial element 5 comprises only one folding or bending area, in particular a bending edge 31 which is provided at the inner surface 17 of the inner partial element 5. In a non-U-shaped state of the plate, the inner partial element 5 hence comprises two V-shaped grooves which can be expanded to an angle of 180° by bending or folding the inner partial element 5 as shown in FIG. 1.

Figure 2:
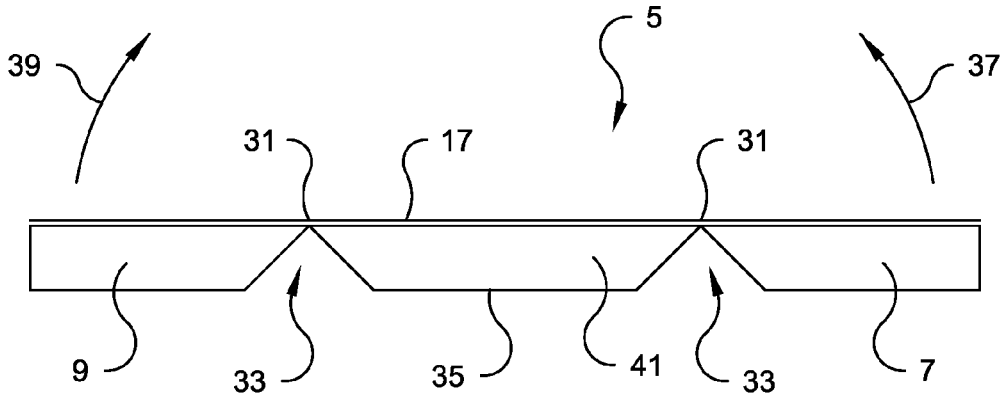
FIG. 2 is a schematic sectional representation of a first outer partial element of a fire protection half-shell element, according to an embodiment of the invention, in a non-folded initial state.

FIG. 2 shows a schematic sectional representation of the inner partial element 5 in a non-bent or non-folded initial state. Identical parts are designated by identical reference numerals, so that reference is made to FIG. 1 in this respect.

FIG. 2 shows the bending areas or bending edges 31 of the inner partial element 5, which extend along a longitudinal direction perpendicular to the image plane and are essentially arranged parallel to each other. The bending edges 31 are formed by the groove bottom of grooves 33 formed in a V-shape which extend from the outer surface 35 of the inner partial element 5 in the direction of the inner surface 17 of the inner partial element 5. The grooves 33 are formed such that the bending edge 31 remains at the groove bottom. The grooves 33 preferably have an angle of essentially 90°.

As already explained above, preferably the entire inner surface 17 of the inner partial element 5 is provided with a metal coating, in particular an aluminum coating. When the legs 9 and 7 are bent in the direction of arrow 37 or 39, the aluminum coating acts as a film hinge so that the inner partial element 5 does not fall apart by the bending or folding of the legs 7 and 9, nor thereafter, even should the porous nonwoven glass fabric coating of the bending edges 31 break during the bending process.

The aluminum film can be applied by appropriate means. It is in particular also conceivable for an aluminum film, in particular an aluminum foil, to be glued to the inner surface 17.

For manufacturing the inner partial element 5 in its final U-shape, the legs 7 and 9, as mentioned, are bent in the direction of arrows 37 or 39, and namely as long as needed until the legs are arranged at an angle of 90° to a base 41 of the inner partial element 5. In this final state, the two legs 7 and 9 are then arranged parallel to each other. Moreover, the grooves 33 can be quasi expanded until same have an angle of 180°. The bottom surfaces of the grooves 33 then form a planar surface, i.e., are arranged in a common plane E (see FIG. 1).

Figure 3:
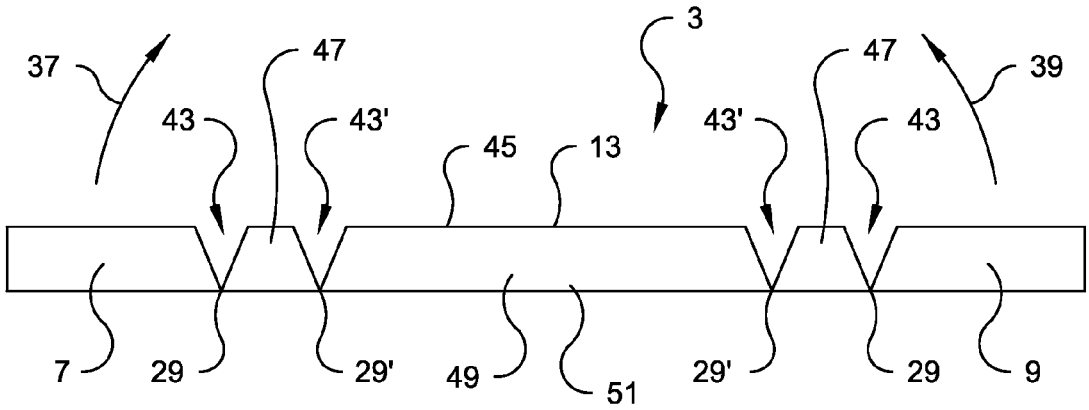
FIG. 3 is a schematic sectional representation of a second inner partial element of a fire protection half-shell element, according to an embodiment of the invention, in a non-folded initial state.

FIG. 3 shows a schematic sectional representation of the outer plate or the outer partial element 3 in an initial state, i.e. in a non-bent or non-folded condition. Identical parts are designated by identical reference numerals so that reference is made to FIGS. 1 and 2 in this respect in order to avoid repetition.

The bending points 29, 29' can be seen in FIG. 3. The outer partial element 3 hence has a total of four folding or bending areas, which are formed by the respective groove bottoms of four grooves 43 and 43' arranged in pairs.

The grooves 43 and 43' of the outer partial element 5 also extend essentially parallel within the outer partial element 3 in a longitudinal direction, i.e., perpendicular to the image plane. The grooves in the inner partial element 5 as well, as the outer partial element 3, can be introduced by appropriate means, e.g., cut into the gypsum plates.

In the outer partial element 3, the grooves 43 respectively 43' preferably extend from an inner surface 45 to the inner partial element 5, so that the bending edges 29, 29' remain. Due to the total of four grooves, the outer partial element 3 is virtually divided into five contiguous sections. Webs 47 are left between two respective grooves 43 and 43', which are displaced jointly with the legs 7 and 9 in the direction of the arrows 37 and 39 during the bending or folding of the outer partial element 3 into its final U-shape.

In order for the legs 7 and 9 to be arranged parallel to each other and at an angle of 90° to a base 49 of the outer partial element 3 in a final state of the outer partial element 3, the grooves 43 and 43' each preferably have an angle of 45°.

Despite its relatively porous structure, the nonwoven glass fabric sheathing, which is in particular also provided on the gypsum core in the area of the bending points or bending edges 29, 29', is completely intact after the bending process of the plate or the partial element 3 in the area of the bending points and does not exhibit any cracks or the like.

It is to be noted at this point that both the second partial element 5 shown in FIG. 2 and the first partial element 3 shown in FIG. 3 represent finished fire protection elements which merely need to be folded.

As a whole, a comparison of FIGS. 2 and 3 makes clear that the grooves 43, 43' are being closed during the manufacturing of the U-shaped outer partial element 3, whereas the grooves 33 are further enlarged during the manufacturing of the U-shaped inner partial element 5. The bending of the two partial elements 3 and 5 hence takes place in a virtually complementary manner. According to this embodiment of the invention, the free space thereby forming in the corner areas 19, 19' between the partial elements 3 and 5 is filled with the connecting elements 21, 21' whereby, on the one hand, the second partial element 5 can be realized in a particularly simple manner and, on the other hand, the fire protection half-shell element 1 exhibits an increased stability.

In a method according to an embodiment of the invention for manufacturing a fire protection half-shell element 1 shown in FIG. 1, or the fire protection elements 3 and 5 shown therein, the following steps are preferably performed:

First, a first partial element 3 and a second partial element 5 are produced, wherein two nonwoven glass fabric-sheathed gypsum plates are processed such that they have essentially U-shaped cross-sections. The U-shaped second partial element 5 is then inserted into the first partial element 3. Subsequently, the first and second partial elements are (directly) connected to each other in the corner areas 19, 19' by a trapezoidal connecting elements 21, 21', as viewed in cross-section in such a manner that a shorter bottom side 25 and legs 23 of each connecting element 21, 21' rests against the inner surface of the first or outer partial element 3, and the longer bottom side 27 of each connecting element rests against the outer surface of the second or inner partial element 5 in an interlocking manner.

It is further preferably provided that four V-shaped grooves 43, 43', arranged parallel to each other in a longitudinal direction, are first introduced into a first plate, namely a first or outer partial element 3, which in each case encloses an angle of 45°, and wherein two grooves 43 and 43' in each case are arranged adjacent each other.

Furthermore, two V-shaped grooves 33, arranged parallel to each other in a longitudinal direction, are introduced into a second or inner partial element 5, with the grooves 33 in each case having an angle of 90°. The groove bottom of a groove introduced in such a manner will then form a bending edge 31 respectively 29, 29', along which the partial elements can be bent into their U-shapes.

In the U-shaped final state, the inner partial element 5 can be inserted into the outer partial element 3, with the two partial elements 3 and 5 being connected to each other in the corner areas 19, 19' by connecting elements 21, 21', so as to finally achieve an interlocking fit of the two elements by way of the connecting elements.

In sum, it is shown that the present invention creates fire protection elements and a fire protection half-shell element, which can be manufactured in a particularly simple and cost-efficient manner, are particularly easy to assemble, and moreover satisfy the highest fire protection requirements, thanks to the nonwoven glass fabric sheathing. Furthermore, the fire protection half-shell element is of a particularly stable configuration, thanks to the connection of the inner and outer partial elements by way of the connecting elements 21 and 21'. The stepped profiles 15, 15', which extend along the fire protection half-shell element 1, ensure that a plurality of fire protection half-shell elements can be connected to each other, such that a protection of the highest resistance against the impact of fire is guaranteed. This applies also in the longitudinal direction, thanks to the corresponding stepped profiles preferably also provided in the longitudinal direction, i.e. at the front and rear ends.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A fire protection element for cladding steel supports, ventilation or cable ducts, the element comprising:

a first outer bent plate and a second inner bent plate, each of the first and second bent plates having a U-shaped cross-section and a pair of legs, one of the legs being a short leg and the other of the legs being a long leg, the second inner bent plate being nested within the first outer bent plate, such that the short leg of the second inner bent plate rests against the long leg of the first outer bent plate and the long leg of the second inner bent plate rests against the short leg of the first outer bent plate, the first outer bent plate having a gypsum core at least partly sheathed with a nonwoven glass fabric.

2. The fire protection element according to claim 1, wherein the fire protection element has a U-shaped configuration.

3. The fire protection element according to claim 1, wherein the nonwoven glass fabric is gypsum-coated.

4. The fire protection element according to claim 1, wherein an outer surface of the first outer bent plate is provided with an intact nonwoven glass fabric layer in bending areas of the plate.

5. The fire protection element according to claim 1, wherein surfaces of the gypsum core are sheathed with a nonwoven glass fabric.

6. The fire protection element according to claim 1, wherein longitudinal edges of the gypsum core are sheathed with a nonwoven glass fabric.

7. The fire protection element according to claim 1, wherein the gypsum core is fiber-reinforced.

8. The fire protection element according to claim 1, wherein the first and second bent plates are configured as corner members.

9. A fire protection half-shell element for cladding steel supports, ventilation or cable ducts, the half-shelf element comprising:

first and second partial elements each having an essentially U-shaped cross-section and a pair of legs, one of the legs being a short leg and the other of the legs being a long leg, the second partial element being nested within the first partial element such that the short leg of the second partial element rests against the long leg of the first partial element and the long leg of the second partial element rests against the short leg of the first partial element, wherein the first and second partial elements are connected to each other at respective corner areas by a respective connecting element.

10. The fire protection half-shell element according to claim 9, wherein the second partial element is an inner partial element and an inner surface of the inner partial element is at least partly provided with a metal coating.

11. The fire protection half-shell element according to claim 10, wherein the metal coating is an aluminum coating.

12. The fire protection half-shell element according to claim 9, wherein at least one of the partial elements has a gypsum core at least partly coated with a nonwoven glass fabric.

13. The fire protection half-shell element according to claim 12, wherein an outer partial element has a gypsum core coated with a nonwoven glass fabric.

14. The fire protection half-shell element according to claim 12, wherein the gypsum core is fiber-reinforced.

15. The fire protection half-shell element according to claim 9, wherein the connecting element has a trapezoidal cross-section.

16. The fire protection half-shell element according to claim 9, wherein the first and second partial elements as viewed in a longitudinal direction are arranged staggered relative to one another, such that the fire protection half-shell element has a stepped profile at its respective longitudinal ends.

17. The fire protection half-shell element according to claim 9, wherein the second partial element is an inner partial element and the first partial element is an outer partial element, and wherein the inner partial element is shorter in a longitudinal direction of the fire protection half-shell element than the outer partial element.

18. The fire protection half-shell element according to claim 9, wherein the first partial element is an outer partial element and a length of the connecting element corresponds to a length of the outer partial element.

* * * * *